United States Patent [19]

Berz et al.

[11] Patent Number: 4,869,437

[45] Date of Patent: Sep. 26, 1989

[54] WIRE COILING APPARATUS WITH A RECOVERY DEVICE FOR A COILED WIRE REEL

[75] Inventors: Gerhard Berz, Leverkusen; Hans J. Braun, Duesseldorf; Guenter Grenz, Meerbusch, all of Fed. Rep. of Germany

[73] Assignee: SMS Schloemann-Siemag Aktiengesellschaft, Dusseldorf, Fed. Rep. of Germany

[21] Appl. No.: 220,604

[22] Filed: Jul. 18, 1988

[30] Foreign Application Priority Data

Jul. 16, 1987 [DE] Fed. Rep. of Germany ..... 3723461

[51] Int. Cl.[4] ..... B65H 54/80; B21C 47/04

[52] U.S. Cl. ..... 242/83; 72/146; 242/82

[58] Field of Search ..... 242/81–84, 242/55, 55.19 R; 73/135, 142, 143, 146

[56] References Cited

U.S. PATENT DOCUMENTS 3,013,742 12/1961 Bittman ..... 242/83
4,012,005 3/1977 Hattersley ..... 242/55.19 X
4,092,007 5/1978 Weatherby et al. ..... 242/55.19 X
4,613,093 9/1986 Takakura et al. ..... 242/55

*Primary Examiner*—Stuart S. Levy
*Assistant Examiner*—Steven M. duBois
*Attorney, Agent, or Firm*—Toren, McGeady & Associates

[57] ABSTRACT

A wire coiling apparatus with extraction device for a coiled wire reel (B) with a coiler basket, comprises two concentrical circular rows of basket rods (1, 4) which stand vertically upon a base plate (3). The base plate (3) can be rotatably driven around a stationary vertical bearing. A reel lifting plate (8) is arranged above the base plate (3) between the circular rows of the basket rods (1, 4) which plate can be moved up and down by means of a central lifting rod (7) in the direction of the central axis of the coiler basket. The basket rods of the outer and/or inner circular row are supported in the base plate so as to be rotatable around their longitudinal axis and they can be arrested in at least two rotational positions. The profile of the basket rods is herein designed in such a manner, that the wire contact faces ($AF_1$, $AF_2$) of the basket rods facing the central axis of the coiler basket in these different rotational positions, have different spacings ($d_1$, $d_2$) from the rotational axis (D) of these rods.

8 Claims, 2 Drawing Sheets

WIRE COILING APPARATUS WITH A RECOVERY DEVICE FOR A COILED WIRE REEL

FIELD AND BACKGROUND OF THE INVENTION

The present invention is directed to a wire coiling apparatus with a recovery device for a coiled wire reel with a reel basket, comprising two concentric rows of basket rods arranged at right angles to a base plate that is rotatably driveable around a stationary vertical bearing. A reel lifting plate is arranged between the circular rows of the basket rods above the base plate, which reel lifting plate is movable up and down in the direction of a central axis of the reel basket by means of a centrally arranged lifting rod. The basket rods of the outer circular row are supported against the inner wall of a cylindrical jacket arranged upon the base plate.

If wire coilers of this type are to coil wire reels of different diameters, then it was hitherto necessary to replace the corresponding basket rods or to utilize replaceable base plates which were equipped with circular rows of basket rods with differing circle diameters. Depending upon the type of construction, the exchanged parts also required reel lifting plates of different dimensions.

SUMMARY OF THE INVENTION

The invention is based upon the task of avoiding the expense connected with the replacement of parts and the storage of parts of different construction as well as avoiding the time expenditure and the installation man hour expenditure required for each changeover. This task is solved in that the basket rods of the outer and/or the inner circular row are supported in the base plates so as to be rotatable and fixable at least in two rotational positions, wherein the profile of the basket rods is designed in such a way that the wire contact faces of the basket rods facing the reel basket's central axis in the different rotational positions have different spacings from their axis of rotation. These contact faces can, in a further refinement of the invention, extend to be curved in an arc-shaped manner and in case of two contact faces these can be offset by 180° to each other.

The radius of the arc of the camber of the contact face, which has the smallest spacing from the axis of rotation of the basket rod is, according to the invention, to be greater than the radius of the arc of the contact face with the larger spacing. The cross-section of the basket rods can taper conically in a known manner from the bottom to the top, advantageously in such a way that only the arcshaped segments arranged to be offset by 180° to each other extend conically tapering from the bottom to the top. The rotatably supported basket rods are supported across their length in a series of bearing segment pairs arranged to be spaced from each other parallel to the direction of the axis of rotation, which bearing segment pairs respectively embrace the outer peripheral region of the bearing rods between the contact faces. The cylinder jacket arranged upon the base plate advantageously has outer cambers encircling the basket rods with a radial spacing in approximately a semicylindrical manner, at whose inner wall these bearing segment pairs are attached. As is furthermore provided in the invention, pinions can be placed on the ends of the basket rods below their bearings in the base plate. All of these pinions mesh with an external crown gear or ring gear supported at the base plate and driven by a motor. Herein, the motor can to be pivotably or axially displaceable into its driving position toward the external crown gear and out of its driving position. Alternatively, the drive pinion of the motor an be axially displaceable into and out of its driving positions. If the motor is not in its driving position, a rotational lock can be shifted into engagement with the external ring gear.

The free spacing between the basket rods of the two concentric circular rows which determines the diameter or the thickness of the coiled wire reel, can in the construction of the wire coiling apparatus in the invention, be changed from one fixed rotational position to another by simple and common rotation of the basket rods around their longitudinal axis, without exchanging components of the wire coiling apparatus. The basket rods can abut against the cylinder jacket due to the centrifugal forces arising during rotation of the coiler basket.

Accordingly, an object of the present invention is to provide a wire coiling apparatus which comprises a base plate, drive means for rotating the base plate about a rotation axis to coil wire into a reel, reel lifting means for lifting the reel from the base plate, inner and outer concentric rows of basket rods extending concentrically around the rotation axis of the base plate to define a coiler basket therebetween, each rod of one of the rows being rotatably mounted to the base plate and being arrestable in at least two different rotational positions, each rod of the one row having a longitudinal axis and at least two wire contact faces which face the coiler basket in the two respective rotational positions, the contact faces having different spacings from the longitudinal axis of the rod to accommodate reels having different thicknesses in the coiler basket.

Another object of the present invention is to provide a wire coiling apparatus which is simple in design, rugged in construction and economical to manufacture.

The various features of novelty which characterize the invention are pointed out with particularity in the claims annexed to and forming a part of this disclosure. For a better understanding of the invention, its operating advantages and specific objectives attained by its use, reference should be had to the drawings and descriptive matter in which there is illustrated and described the preferred embodiment of the invention.

DESCRIPTION OF THE PREFERRED EMBODIMENT

Figure 1:
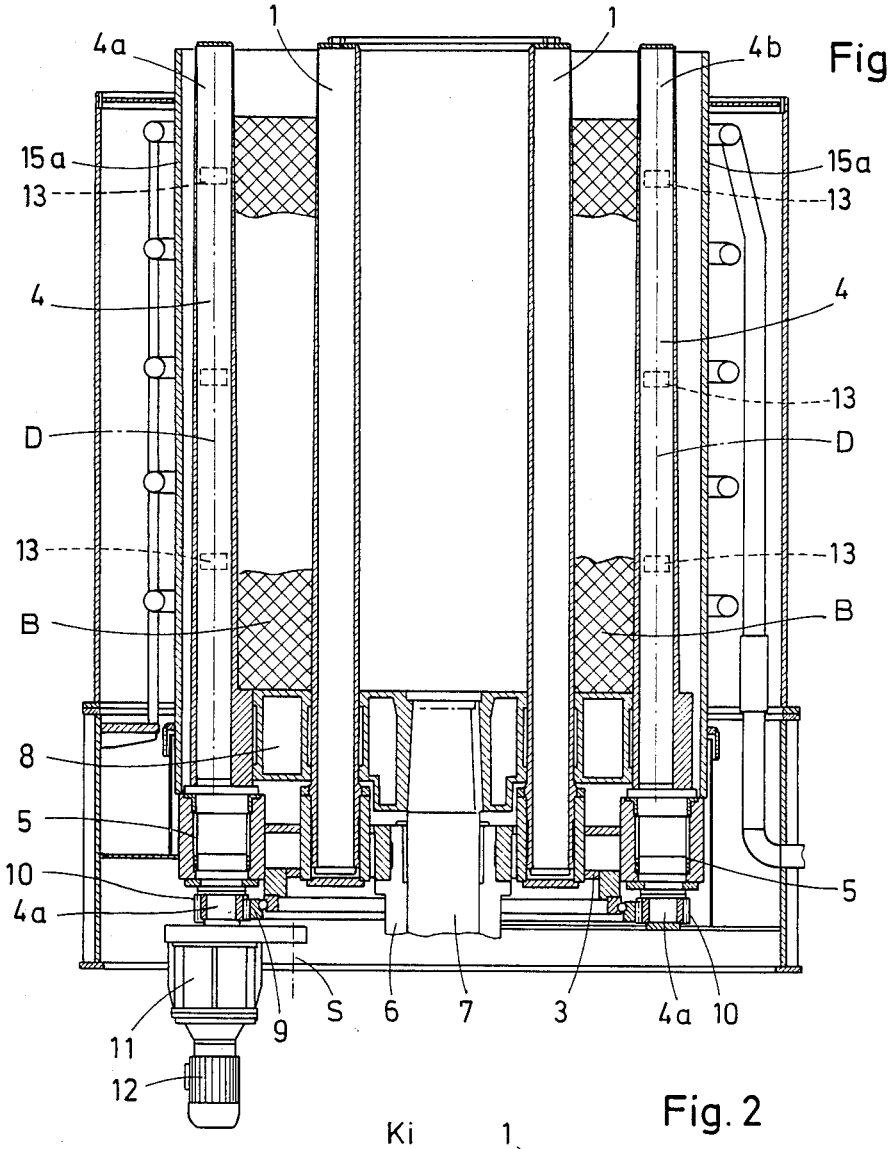
FIG. 1 is an axial sectional view of the coiling basket.
Figure 2:
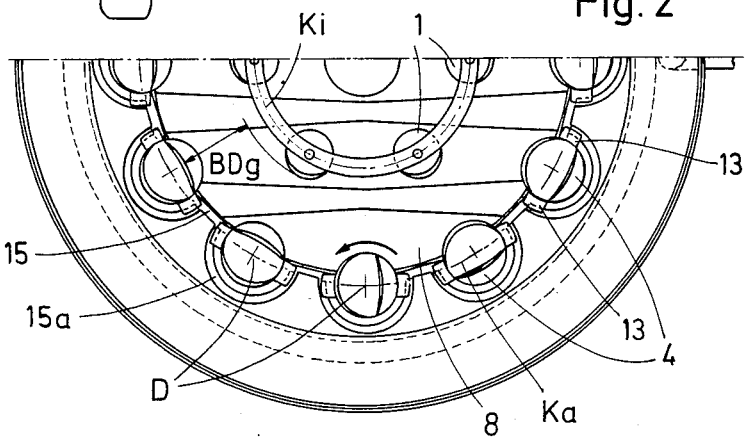
FIG. 2 is a partial plan view of the basket of FIG. 1.

As can be discerned from FIGS. 1 and 2, an inner circular row $K_i$ of the basket rods 1 are inserted into a base plate 3 so as to be non-rotatable therein. Basket rods 4 of an outer circular row $K_a$ are supported in bearings 5 in the base plate 3 so as to be each rotatable around an axis of rotation D. The base plate 3 sits in a hollow shaft 6 which can be driven so as to rotate in a manner not depicted here. A lifting rod 7 is guided in hollow shaft 6, so that it can be moved up and down in a manner which is also not shown. A reel lifting plate 8 is seated upon the lifting rod 7, with which a wire reel indicated at B can be raised and taken out of the coiling apparatus basket formed by the reel rods 1 and 4. Furthermore, a ring gear 9 is supported at the base plate 3 which meshes with pinions 10 which are mounted on the lower ends 4a of the basket rods 4. The ring gear 9 is driven by a motor 12 through a transmission 11. Motor 12, with its non-depicted drive pinion, can be pivoted around the pivot axis S shown in broken dotted lines so that its drive pinion is pivoted in and out of meshing position with the ring gear 9. There is however also the possibility of arranging the motor 12 with the transmission 11 in such a way that it is shifted vertically into and out of driving position, or to equip it with a displaceable drive pinion. This arrangement of the motor 12 with transmission 11 is required because the drive pinion of the motor must be brought out of meshing engagement with the external ring gear 9 during the rotational drive of the base plate 3. A lock which is known as such and not depicted is then inserted into this external ring gear 9.

In this case the basket rods 4 have (compare FIG. 3) contact faces $AF_1$, $AF_2$ extending in an arc-shaped camber which are arranged to be offset by 180° against each other. The contact face $AF_1$ facing the coiler basket's central axis has herein an average spacing d1 from the axis of rotation D, which is smaller than the average spacing d2, of the contact face $AF_2$ facing away from the central axis of the coiler basket. The spacing between the contact face $AF_1$ of the basket rod 4 and the contact face $AF_i$ of the basket rod 1 which determines the reel thickness $BD_g$ or the corresponding reel diameter, is in the depicted position greater than the corresponding spacing $BD_k$ between the contact face $AF_2$ of the basket rods 4 depicted in broken dotted lines and the contact face $AF_i$ of the basket rod 1, if this basket rod has been rotated through 180° from the position shown in FIG. 3.

To rotate the rods 4 so that one or the other of the wire contacting faces $AF_1$ or $AF_2$ is facing the interior of the coiler basket between the concentric rows of rods, motor 12 is rotated on its pivot S to engage its driving pinion with the ring gear 9 and the motor is momentarily activated to rotate the pinion which, in turn, rotates all of the rods 4 by 180°. Motor 12 is then pivoted to disengage from ring gear 9 and the lock is engaged to lock ring gear 9 to base plate 3 for corotation of these two parts. Hollow shaft 6 can then be rotated to rotate base plate 3 and its inner and outer rows of rods 1 and 4, to coil wire into reel B in the coiler basket between the rows of rods.

Figure 3:
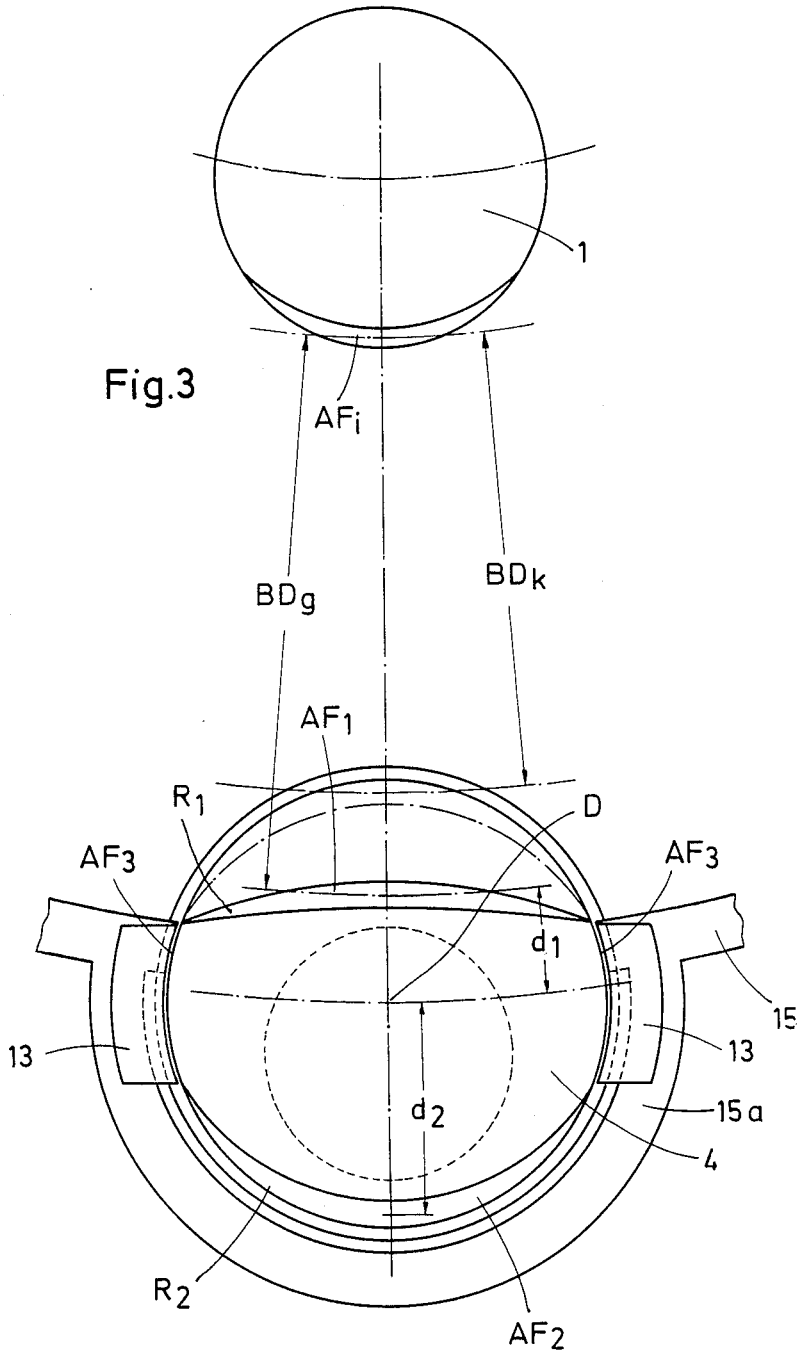
FIG. 3 is a detailed view from FIG. 2, shown on an enlarged scale.

As can be also discerned from FIG. 3 the arc radius R1 of the contact face $AF_1$ is greater than the arc radius R2 of the contact face $AF_2$ and both contact faces taper from the bottom to the top, meaning from the base plate 3 toward the free end 4b of the basket rods 4. The outer peripheral surface regions $AF_3$ of the basket rods 4 located on the sides between the two contact faces $AF_1$ and $AF_2$ are embraced by the bearing segment pairs 13 and are supported therein as best shown in FIG. 3. These bearing segment pairs 13 are fastened in outer cambers 15a of the cylinder jacket 15 arranged upon the base plate 3 which embrace the corresponding basket rod 4 approximately in a semi-cylindrical fashion.

What is achieved by this arrangement is that the components of the centrifugal forces acting upon the basket rods 4 during rotation of the coiler basket are carried by the bearing segment pairs embracing and holding the basket rods 4 and are transmitted to the outer cambers 15a acting as stiffening elements of the cylinder jacket.

While a specific embodiment of the invention has been shown and described in detail to illustrate the application of the inventive principles, it will be understood that the invention may be embodied otherwise without departing from such principles.

What is claimed is:

1. A wire coiling apparatus, comprising:

a base plate;

drive means connected to said base plate for rotating said base plate about a rotation axis to coil wire into a reel;

reel lifting means operatively connected to said base plate for lifting a reel from said base plate;

inner and outer circular rows of basket rods extending concentrically around the rotation axis of said base plate and from said base plate to define a coiler basket therebetween for a reel to be formed and held;

each rod of at least one of said rows being mounted for rotation to said base plate about a longitudinal axis; and means for arresting said rods of said at least one row in at least two rotational positions, each rod of said at least one row having at least two wire contact faces which face the interior of said coiler basket in said two respective rotational positions, each wire contact face having a different spacing from said longitudinal axis.

2. An apparatus according to claim 1, wherein said contact faces are each cambered in an arc-shaped manner.

3. An apparatus according to claim 2, wherein said at least two contact faces are offset by about 180° from each other around said longitudinal axis.

4. An apparatus according to claim 2, wherein the radius of the arc of the camber for said contact face with a smaller spacing from said longitudinal axis is greater than the radius of the arc of the camber for said contact face with the larger spacing from said longitudinal axis.

5. An apparatus according to claim 1, wherein said each rod of at least one of said rows has a cross section which tapers conically in a direction away from said base plate.

6. An apparatus according to claim 2, wherein said cambered contact faces taper conically in a direction away from said base plate.

7. An apparatus according to claim 1, wherein each rod of said at least one row includes an outer peripheral surface region between said at least two wire contact faces, and a plurality of bearing segment pairs connected to said basepplate and engaging said outer peripheral surface region for supporting each rod of said at least one row in each of said rotational positions thereof.

8. An apparatus according to claim 7, including a cylindrical jacket connected to said base plate and extending around the rotation axis, said cylindrical jacket including a plurality of circumferentially spaced cambers, each engaged at least partly around one of said rods of said at least one row, said plurality of bearing segment pairs each being connected to one of said cambers.

* * * * *